US006000081A

United States Patent [19]

Sheridan

[11] Patent Number: 6,000,081

[45] Date of Patent: Dec. 14, 1999

[54] METHOD OF MANUFACTURING A LAST

[76] Inventor: James Sheridan, 7 Lismacarol Park, Drumahoe, County Londonderry BT47 3XT, United Kingdom

[21] Appl. No.: 08/981,720

[22] PCT Filed: Jun. 21, 1996

[86] PCT No.: PCT/EP96/02786

§ 371 Date: Feb. 18, 1998

§ 102(e) Date: Feb. 18, 1998

[87] PCT Pub. No.: WO97/00628

PCT Pub. Date: Jan. 9, 1997

[30] Foreign Application Priority Data

Jun. 23, 1995 [GB] United Kingdom ..... 9513204

[51] Int. Cl.[6] ..... A43D 5/00; A43D 3/02

[52] U.S. Cl. ..... 12/115.6; 12/146 L; 12/133 R

[58] Field of Search ..... 12/146 L, 133 R, 12/115.6, 128 R, 123

[56] References Cited

U.S. PATENT DOCUMENTS 2,941,220 6/1960 Schick .

FOREIGN PATENT DOCUMENTS

| | | |
|---|---|---|
| 397904 | 8/1994 | Austria . |
| 476323 | 3/1936 | Germany . |
| 8425684 | 11/1984 | Germany . |
| 432414 | 7/1935 | United Kingdom . |
| 583659 | 12/1946 | United Kingdom . |
| 765371 | 1/1957 | United Kingdom . |

*Primary Examiner*—Ted Kavanaugh

*Attorney, Agent, or Firm*—Woodcock Washburn Kurtz Mackiewicz & Norris LLP

[57] ABSTRACT

A method of manufacturing a last for a first article of footwear. The last comprising a cast shaped and dimensioned to customize, in use, one end of the first article of footwear for one end of an individual's foot, and an end piece adapted to engage, in use, the opposite end of the first article of footwear. The method comprising the steps of customizing the cast and fixing the cast.

3 Claims, 6 Drawing Sheets

METHOD OF MANUFACTURING A LAST

This application is a 371 of PCT/EP96/02786 filed on Jun. 21, 1996.

TECHNICAL FIELD

The present invention relates to a method of manufacturing a last for an article of footwear and a last for an article of footwear. The term "last" as used herein is intended to embrace both a shoemaker's model for making, shaping and/or repairing an article of footwear and a shaped block or shoe-tree for shaping or maintaining in shape an article of footwear. The present invention has particular application in the field of customised articles of footwear.

BACKGROUND ART

GB-A-765,371, discloses a method of making shoe-trees in which a plater cast is made of the front part of an individual's foot and fixed to an end piece to form a shoe tree. Such a shoe tree suffers the disadvantage that the plaster cast reflects the shape of the external surface of the individual's foot when the foot is not restrained by an article of footwear. Since much of contemporary fashion footwear causes an individual's foot to be deformed to some extend, a shoe-tree formed in accordance with GB-A-765,371 would not necessarily be insertable in such fashion footwear.

GB 476,323 discloses a method for making an orthopaedic last derived from an orthopaedically correct old shoe, from which last an orthopaedically correct arch of a new shoe can be subsequently manufactured. The orthopaedic last is formed by filling the orthopaedically correct old shoe with a plastic material and allowing said material to set. Such a method suffers from the disadvantage that it can only be performed using old shoes whose bodies do not comprise straps or apertures since such footwear could not contain the un-set plastic material. The methods of GB 476, 323 would not therefore be suitable for many styles of contemporary fashion footwear.

DISCLOSURE OF THE INVENTION

According to the present invention there is provided a method of manufacturing a last for a first article of footwear, the last comprising a cast shaped and dimensioned to customise, in use, one end of the first article of footwear for one end of the individual's foot; and an end piece adapted to engage, in use, the opposite end of the first article of footwear, said method comprising the steps of customising the cast for said one end of the individual's foot; and fixing the cast to the end piece.

Preferably, the customising step comprises forming the cast from the internal surface of one end of a second article of footwear.

Alternatively, the customising step comprises forming a mould of the external surface of one end of the individual's foot; and forming the cast from the mould.

Preferably, the cast is formed by lining the internal surface of one end of the second article of footwear; and filling the lining with a material which is suitable for forming the cast.

Further preferably, the lining is formed from latex rubber or the like.

Advantageously, the method additionally comprises the step of customising the end piece for the opposite end of the individual's foot.

More advantageously, the customising step comprises forming the end piece from the internal surface of said opposite end of the second article of footwear.

Even more advantageously, the end piece is formed by lining the internal surface of said opposite end of the second article of footwear; and filling the lining with a castable material.

Alternatively, the customising step comprises forming a mould of the external surface of the opposite end of the individual's foot; and forming the end piece from the mould.

According to a second aspect of the invention, there is provided a last for a first article of footwear, the last comprising a cast shaped and dimensioned to customise, in use, one end of the first article of footwear for one end of an individual's foot; an end piece adapted to engage, in use, the opposite end of the first article of footwear; and means for fixing said cast to said end piece.

Preferably, the cast conforms substantially to the shape of the internal surface of one end of a second article of footwear.

More preferably, the end piece conforms substantially to the shape of the internal surface of the opposite end of the second article of footwear.

Even more preferably, the internal surface of the second article of footwear has been pre-shaped by the individual's foot through wear.

Alternatively, the cast conforms substantially to the shape of the external surface of one end of the individual's foot.

More advantageously, the cast is made from a mould of the external surface of said one end of the individual's foot.

Even more advantageously, the end piece conforms substantially to the shape of the external surface of the opposite end of the individual's foot.

Still more advantageously, the end piece is made from a mould of the external surface of said opposite end of the individual's foot.

Preferably, the cast is formed from polyester resin or the like material.

More preferably, the end piece is formed from polyester resin or the like material.

Even more preferably, the mould is formed from fiberglass or the like material.

Further preferably, the fixing means comprises resilient means arranged to urge, in use, the cast and the end piece into engagement with the first article of footwear.

BRIEF DESCRIPTION OF THE DRAWINGS

Two embodiments of the invention will now be described, by way of example, with reference to the accompanying drawings, in which.

DESCRIPTION OF THE PREFERRED EMBODIMENTS

Figure 1:
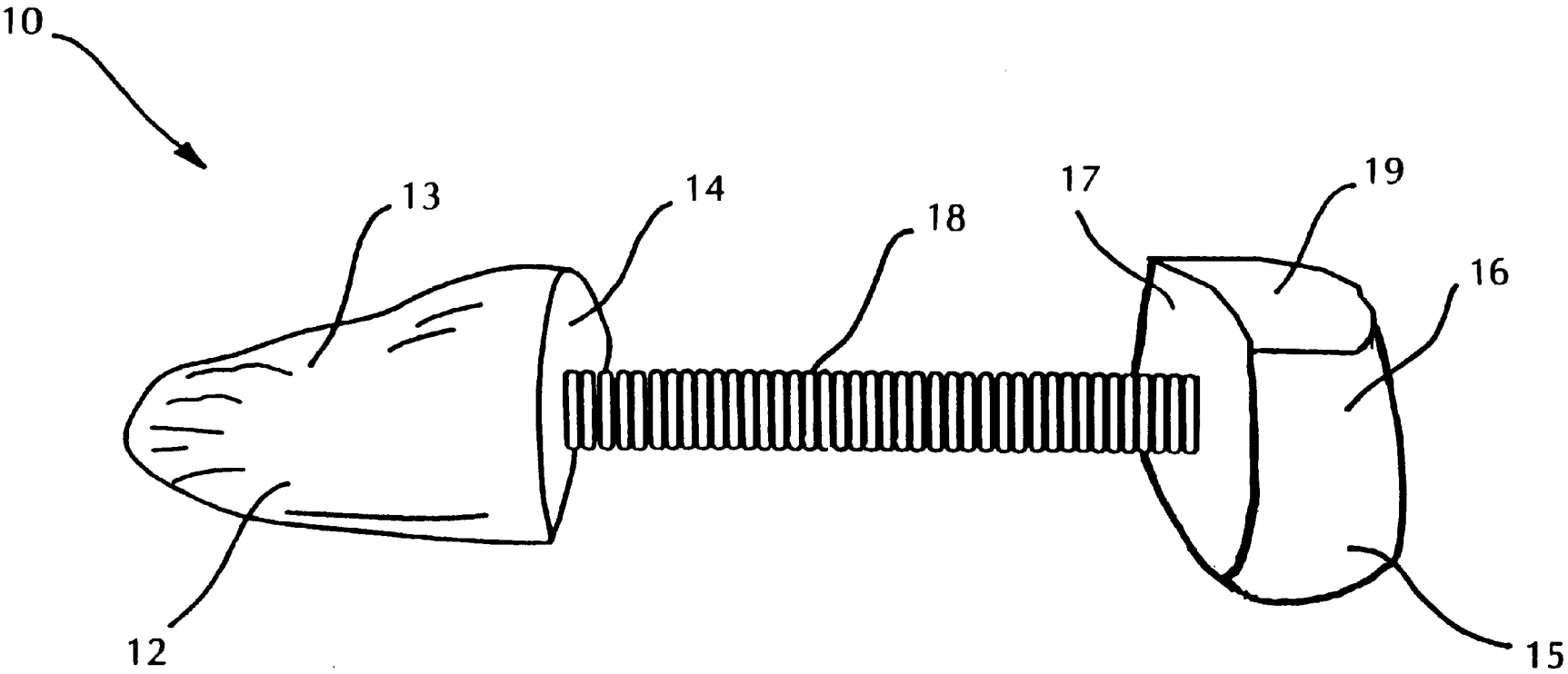
FIG. 1 is a perspective view of a last according to the invention.

Referring now to FIG. 1 and FIGS. 3*a* to 3*d*, there is shown a last generally indicated at 10 according to the invention. The last 10 comprises a cast in the form of a front cast 12, an end piece in the form of a heel cast 15 and fixing means in the form of resilient means as a compression spring 18. The front cast 12 has a shaped surface 13 and a rear face 14. The heel cast 15 has a shaped surface 16, a front face 17 and a top face 19. In FIG. 1, the compression spring 18 is illustrated in a compressed state.

The front cast 12 of the last 10 according to the invention is manufactured by lining the internal surface of the front end of a second article of footwear with a non-permeable material, for example latex rubber, polythene or the like. A second article of footwear, which has been pre-shaped by an individual's foot through wear, is a particularly suitable article of footwear for this purpose.

The lining is filled with a liquid, for example, polyester resin, although any suitable castable liquid 34 may be employed. The liquid is caused to substantially harden, for example by curing, to form the front cast 12 which is then removed from the second article of footwear 30.

It will be understood that the front end of the second article of footwear 30 refers to the area substantially from the instep to the toe of that article of footwear.

The heel cast 15 is formed by repeating the above-mentioned process using the internal surface of the opposite or heel end of the second article of footwear or shoe.

The last 10 according to the invention is constructed by fixing the rear face 14 of the front cast 12 to the front face 17 of the heel cast 15 using the resilient means or compression spring 18.

A number of conventional methods may be used to fix the spring 18 between the front cast 12 and the heel cast 15. For example, each end of the spring 18 may be inserted into the front or rear cast 12, 15, respectively before they fully harden, allowing each cast 12, 15 to positively engage the spring 18 once hardened. Alternatively, the front and rear faces 17, 14 of the casts 15, 12, respectively, can be threaded to allow the spring 18 to be screwed into each cast 12, 15. Depending on the nature of the castable liquid used to form the casts 12, 15, it may be possible to adapt each end of the spring 18 to self thread into each of the front or rear faces 17, 14 of the casts 15, 12 respectively.

The length of the spring 18 is determined by the length of the individual's foot. The length of the spring 18 is chosen so that, when the spring 18 is substantially fully but, not completely, extended, the last 10 fits fully along the length of the individual's first article of footwear 36, from heel to toe.

Typically, a compression spring with a half inch bore is suitable for connecting the casts 12, 15. It will be appreciated that the purpose of the compression spring 18 is to urge the front cast 12 and the heel cast 15 into engagement with the front end and heel end, respectively, of the first article of footwear 36 and that, accordingly, the compression spring 18 could be replaced by any alternative conventional fixing means adapted to urge each end of the last 10 into engagement with each end of the first article of footwear, for example, an extendable bar (not shown).

It will be appreciated that, for each shoe of a pair of first articles of footwear, a last 10 according to the present invention must be made from the respective shoe of a pair of second articles of footwear, most preferably, a pair of shoes pre-worn by that individual.

Figure 2:
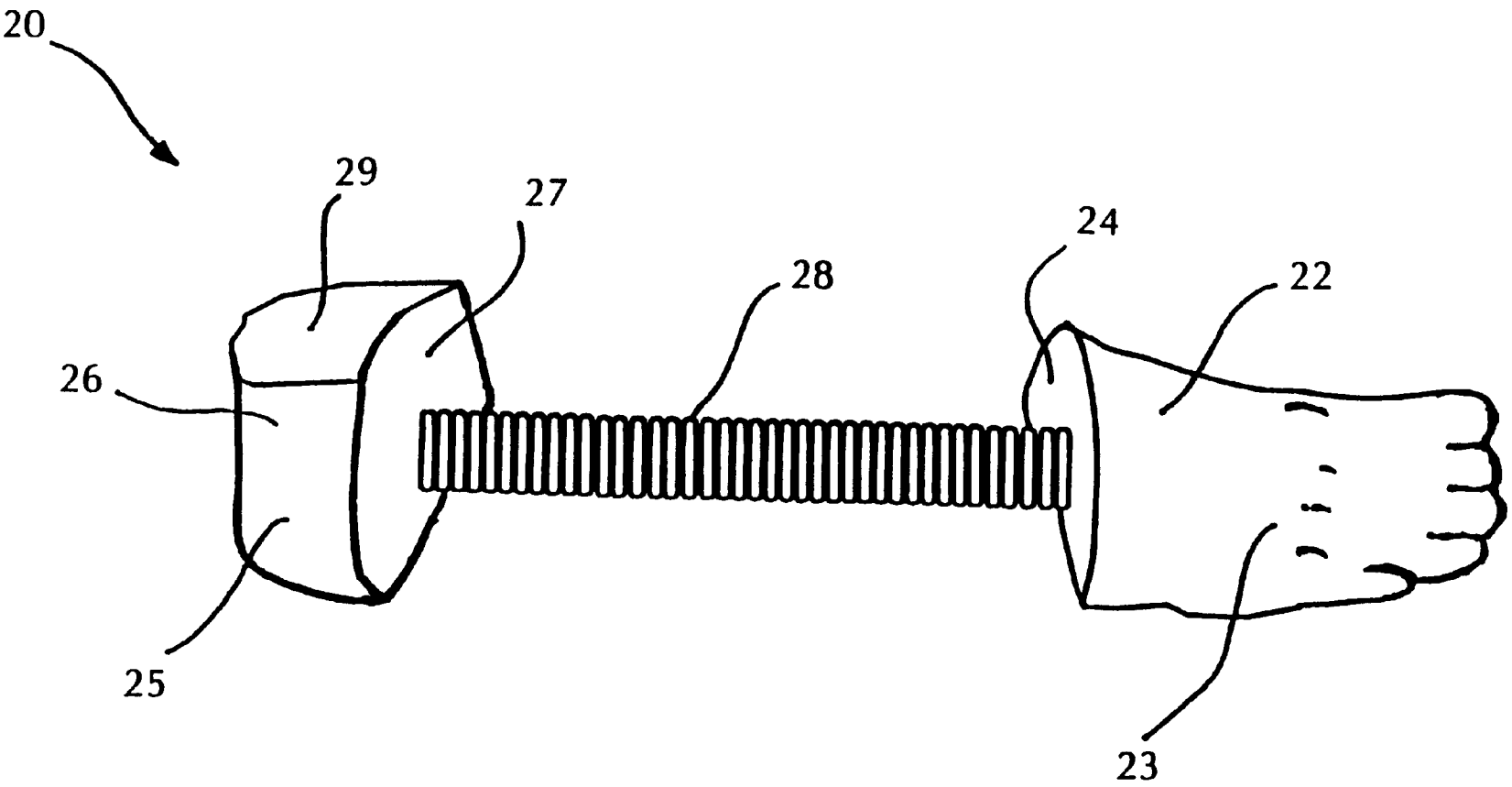
FIG. 2 is a perspective view of an alternative last.
Figure 3A:
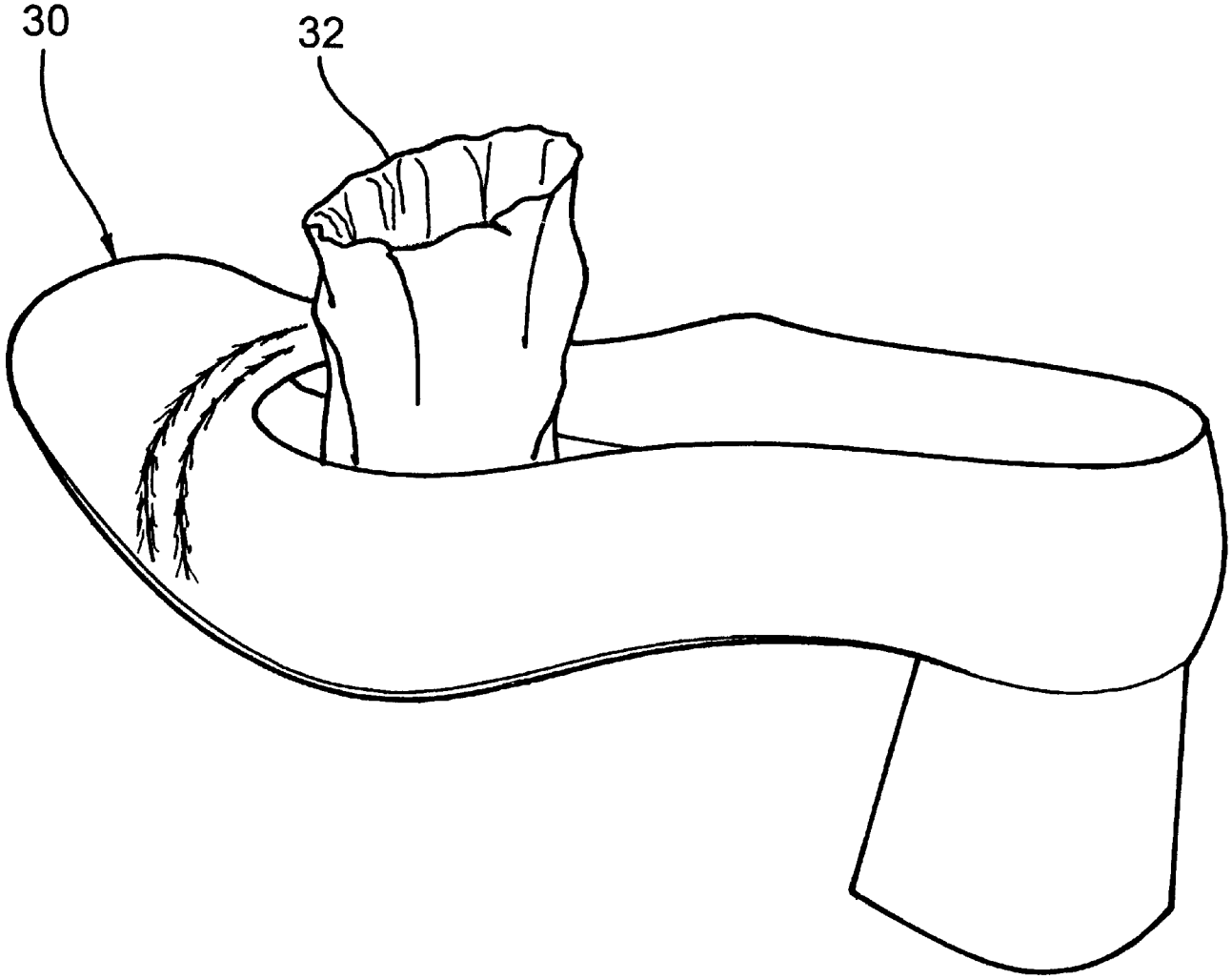
FIG. 3*a* is a perspective view of a second article of footwear into which a lining is partially inserted.
Figure 3B:
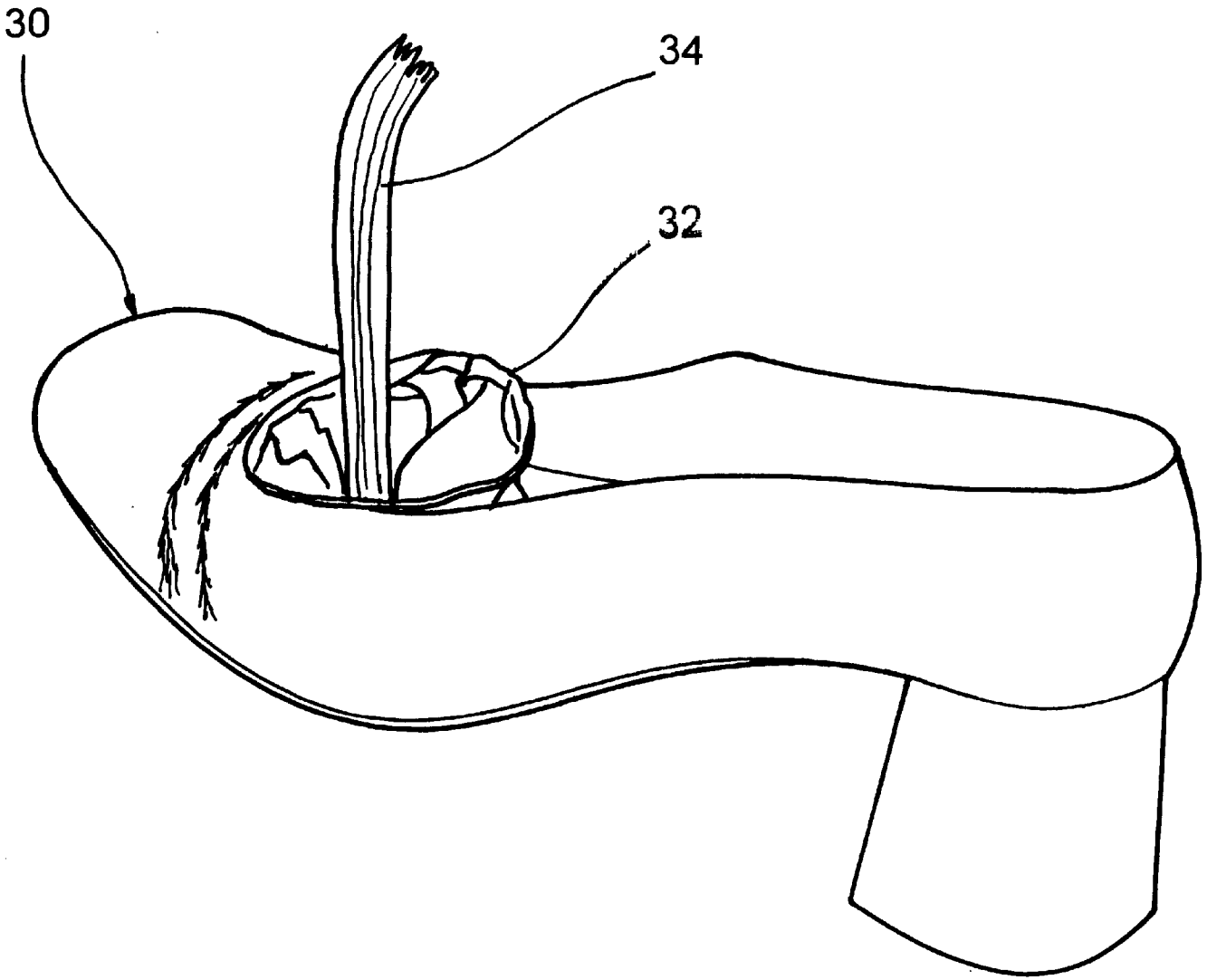
FIG. 3*b* is a perspective view of the second article of footwear in which the lining is being filled with a castable material.
Figure 3C:
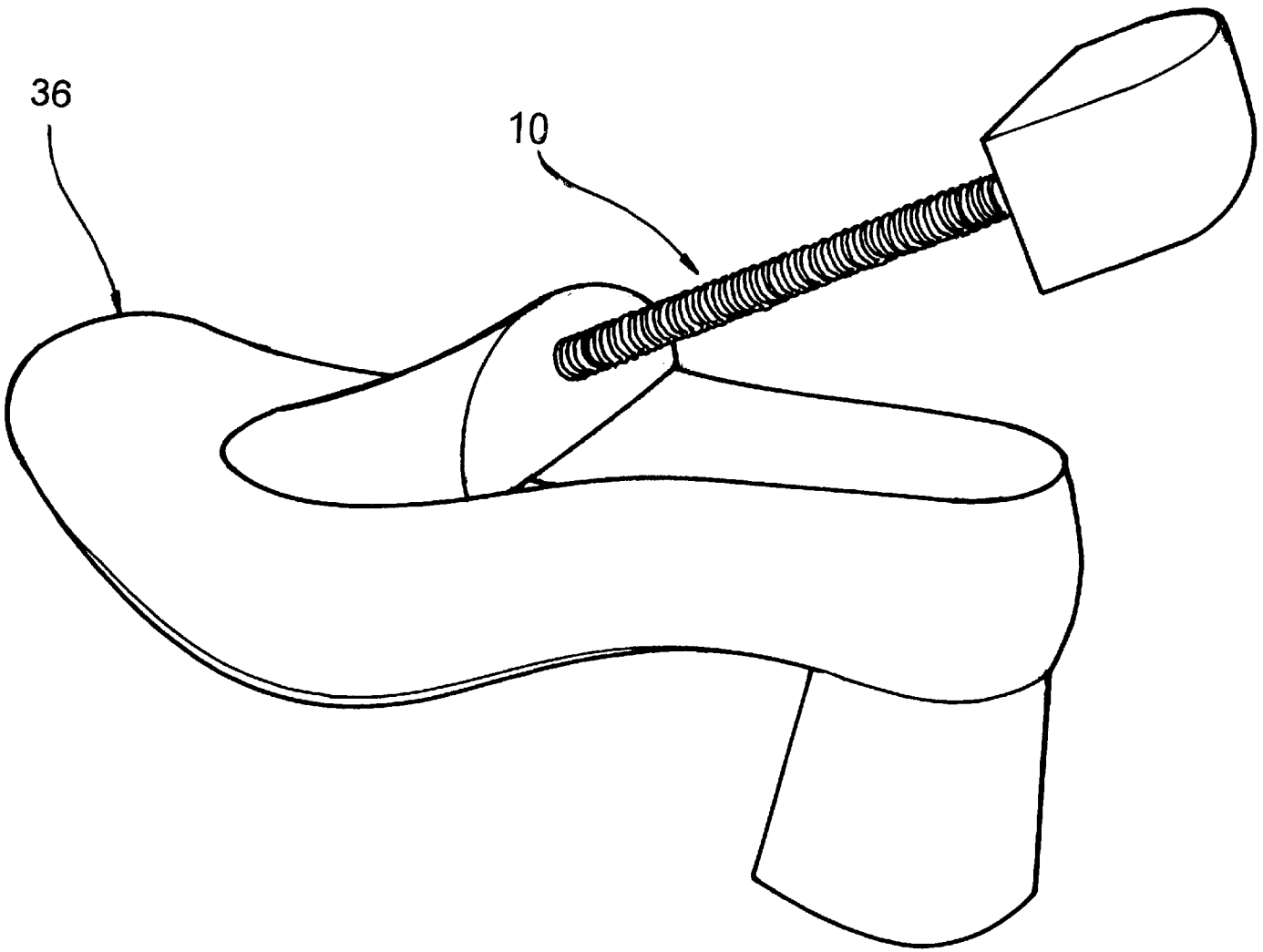
FIG. 3*c* is a perspective view of a first article of footwear into which a last is partially inserted.
Figure 3D:
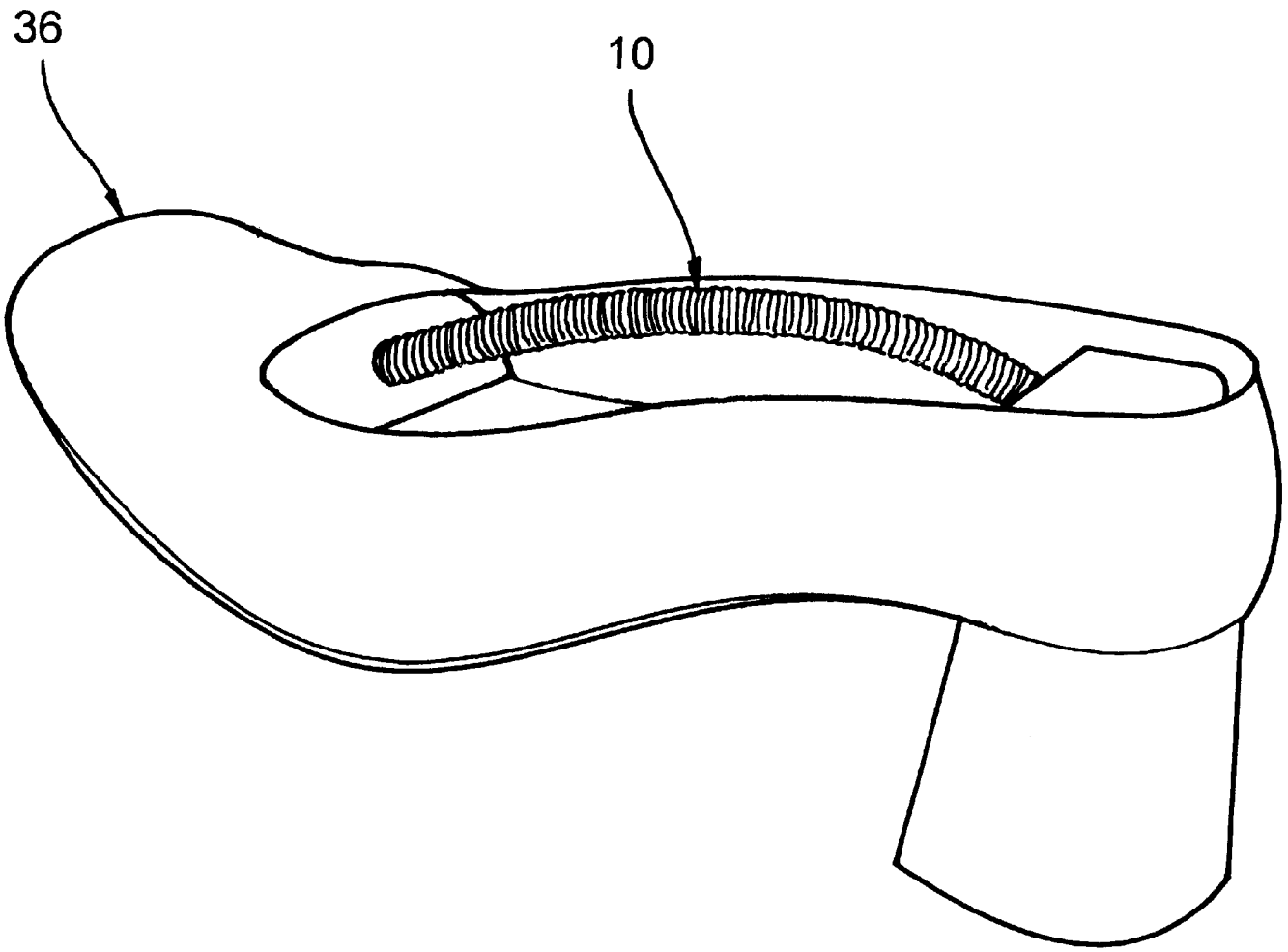
FIG. 3*d* is a perspective view of the first article of footwear and the last.

Referring now to FIG. 2, there is shown a last generally indicated at 20. The last 20 comprises a front cast 22, a heel cast 25 and resilient means in the form of a compression spring 28. The front cast 22 has a shaped surface 23 and a rear face 24. The heel cast 25 has a shaped surface 26, a front face 27 and a top face 29. In FIG. 2, the compression spring 28 is illustrated in a compressed state.

The front cast 22 of the last 20 is manufactured by lining the external surface of the front end of an individual's foot (not shown) with fibreglass (not shown) or any other material suitable for forming a mould. The fibreglass or the like material is caused to harden by the application of an appropriate curing agent, thus forming a mould (not shown) of the front end of the foot. The mould is then removed from the foot.

The mould is filled with a castable liquid (not shown), for example, polyester resin. The liquid is caused to substantially harden, by curing, for example, to form the front cast 22 which is then removed from the mould.

It will be understood that the front end of the foot refers to the area substantially from the instep to the toes of that foot.

The heel cast 25 is formed by repeating the process using the external surface of the heel area of the foot (not shown) to form the mould and then forming a cast using the mould.

The last 20 is constructed by connecting the rear face 24 of the front cast 22 to the front face 27 of the heel cast 25 using the compression spring 28. The length of the spring 28 and its compression properties are selected, and the spring 28 is connected between the front and heel casts 22, 25, in the manner described above in relation to the FIG. 1 embodiment.

The shaped surfaces 13, 23 and 16, 26 are thus customised or contoured to conform to the shape of the front and heel ends respectively, of the individual's foot. In this connection, it should be noted that the last 20 conforms to the shape of the individual's foot more accurately than the last 10.

In use, a last 10 or 20, is inserted into a first article of footwear such as a shoe of an unworn pair of shoes. Initially, the front cast 12, 22 of the last 10, 20 might not fit fully into the front end of the unworn shoe, causing compression in the spring 18, 28. Similarly, the rear casts 15, 25 of the last 10, 20 might not fit fully into the rear or heel end of the unworn shoe. However, the force exerted by the compressed spring 18, 28 gradually pushes the front cast 12, 22 fully into the front end of the shoe and the rear cast 15, 25 fully into the rear end of the shoe. The last 10, 20 thus fits entirely along the length of the shoe, from heel to toe.

In this position, the shaped surfaces 13, 23 and 16, 26 exert pressure on the front and heel areas, respectively, of the unworn shoe. These pressures are substantially similar to the pressures which would be exerted by an individual's foot.

An unworn shoe can thus be customised or specifically shaped to suit the shape of an individual's foot, thereby alleviating the discomfort which must be endured when breaking-in an unworn pair of shoes.

It will be appreciated that end pieces or rear casts 15, 25 need not necessarily conform to the heel end of the individual's foot but must, in any event, be adapted to engage, in use, the first article of footwear so that the front cast 12, 22 is urged into engagement with the front end of the first article of footwear under the influence of the resilient means or compression spring 18, 28. Thus, or example, if a particular individual encounters discomfort in breaking in only the front ends of shoes, customised rear casts 15, 25 can be dispensed with. Similarly, if a particular individual encounters discomfort in breaking in only the heel ends of shoes, customised rear casts 15, 25 should be formed and the end pieces or front casts 12, 22 need not be customised as described above but must, in any event, be adapted to engage, in use, the first article of footwear so that the rear cast 15, 25 is urged into engagement with the rear end of the first article of footwear under the influence of the resilient means or compression spring 18, 28. Thus the terms "cast" and "end piece" as used herein are to be used interchangably and are each intended to embrace the front and heel areas of the individual's foot.

It will also be appreciated that the last 10, 20 according to the invention facilitates a shoe-maker in making, shaping and/or repairing articles of footwear customised or specifically shaped to suit the shape of an individual's foot.

I claim:

1. A method of manufacturing a last for a first article of footwear, the last comprising a cast shaped and dimensioned to customize, in use, one end of the first article of footwear for one end of an individual's foot; and an end piece adapted to engage, in use, the opposite end of the first article of footwear, said method comprising the steps of customizing the cast for said one end of the individual's foot; and fixing the cast to the end piece characterized in that the customizing step comprises lining the internal surface of one end of a similar sized second article of footwear; substantially filling the lining with a material which is suitable for forming the cast; and removing the resulting cast.

2. A method according to claim 1, in which the lining is formed from latex rubber.

3. A method according to claim 1 or 2, in which the end piece is formed by lining the internal surface of the opposite end of the second article of footwear; substantially filling the lining with a castable material; and removing the resulting cast.

* * * * *